United States Patent [19]

Longrod

[11] Patent Number: 4,976,556

[45] Date of Patent: Dec. 11, 1990

[54] PRINT CARRIER RACK DRIVE

[75] Inventor: Scott J. Longrod, Lansing, N.Y.

[73] Assignee: Smith Corona Corporation

[21] Appl. No.: 295,186

[22] Filed: Jan. 9, 1989

[51] Int. Cl.[5] ..... B41J 19/30

[52] U.S. Cl. ..... 400/320; 400/328

[58] Field of Search ..... 400/305, 306.2, 306.3, 400/306.4, 307, 307.1, 307.2, 320, 322, 328, 330, 330.1, 330.2, 330.3, 330.4, 330.5, 330.6, 330.7, 330.8, 331, 331.1, 331.2, 331.3, 332, 332.5, 332.6

[56] References Cited

U.S. PATENT DOCUMENTS

| | | | |
|---|---|---|---|
| 295,475 | 3/1884 | Barron | 400/331 |
| 565,728 | 8/1896 | Fairfield | 400/332.5 |
| 3,028,942 | 4/1962 | Page | 400/330.8 |
| 3,872,960 | 3/1975 | Gabor | 400/335 |
| 4,019,616 | 4/1977 | Thorne | 400/320 |
| 4,403,879 | 9/1983 | Vought et al. | 400/322 X |
| 4,461,588 | 7/1984 | Watanabe et al. | 400/328 X |
| 4,526,486 | 7/1985 | Kikuchi et al. | 400/322 X |
| 4,576,490 | 3/1986 | Isobe | 400/328 X |
| 4,687,361 | 7/1987 | Kikuchi et al. | 400/322 |
| 4,750,881 | 6/1988 | Kikuchi et al. | 400/320 X |

FOREIGN PATENT DOCUMENTS

| | | | |
|---|---|---|---|
| 0145025 | 6/1985 | European Pat. Off. | 400/322 |
| 0194581 | 9/1986 | European Pat. Off. | 400/320 |
| 0161184 | 12/1981 | Japan | 400/322 |
| 0127174 | 7/1985 | Japan | 400/320 |
| 0161166 | 8/1985 | Japan | 400/320 |
| 0284776 | 12/1987 | Japan | 400/328 |

*Primary Examiner*—David A. Wiecking

[57] ABSTRACT

An improved carriage moving mechanism on a frame for a typewriter of printer.

(a) The carriage is movably mounted on a guide rail for longitudinal movement on the frame;

(b) The traveling motor is fixedly mounted on the carriage including a pinion attached to a rotary shaft of the motor;

(c) The rack is attached to the frame extending longitudinally substantially in parallel to the guide rail;

(d) The rack is rigid longitudinally thereof and is flexible in a flex direction perpendicular to the longitudinal direction, the rack including a tooth side adapted to engage with said pinion, the surface of the rack including the line of teeth and its surface opposite the pinion being substantially parallel to the guide rail; and (e) A spring loaded slider assembly is mounted as a part of the carriage and is adapted to make continuous sliding contact with the surface of the rack in opposition to the tooth surface of the rack in the area of the pinion rotation.

5 Claims, 5 Drawing Sheets

PRINT CARRIER RACK DRIVE

BACKGROUND OF THE INVENTION

1. Field of Invention

The present invention relates to printer positioning apparatus for use in high speed printers or the like and more particularly to a new and improved carrier moving rack and pinion apparatus in applications such as printers.

2. Description of The Prior Art

Prior art carrier moving mechanisms are known for use in both impact and ink jet type printers. In such mechanisms, a printing head is mounted on a carrier and movably attached to a guide rail. The carrier is moved either by a travelling or fixed motor which must position the printing head precisely in order to achieve the desired spacing between and among the characters printed upon paper or other medium.

Carrier moving mechanisms of the rack and pinion type all move the carrier by use of thrust force generated by a travelling motor rotating a pinion engaged in a rack mounted roughly parallel to one or more guide rails and to the exposed face of the medium upon which characters are to be printed. The principal advantage of rack and pinion type carrier moving mechanisms is the increased accuracy such devices allow in locating the printing head. Forward and reverse movement of the carrier mechanism is achieved by directional rotation of the pinion.

Prior art making use of rack and pinion type carrier moving mechanisms presents printer manufacturers with a dilemma. Designs utilizing close tolerances in the mechanism produce highly accurate character location. However, manufacturing to close tolerances is expensive. With use, machines so manufactured suffer greater wear and consequent mechanical break down and loss of accurate character placement. Conversely, machines manufactured to wider tolerances are cheaper to manufacture and suffer less mechanical deterioration. However, these advantages are obtained at the cost of lost precision in locating the printer head carrier mechanism. Hence, the rack, and pinion method of carrier movement and location, although attractive in addressing the problem of printer device placement, presents manufacturers with an inherently undesirable compromise among interrelated competing concerns: cost, accuracy of placement, and frequency of need for maintenance.

Prior U.S. Pat. No. 4,687,361 dated Aug. 18, 1987 by Kikuchi et al. represents an attempt to address and resolve this dilemma. For the purpose of the comparison, the distinctive characteristic of this prior art patent is that the rack is oriented on edge so that the teeth and the pinion engage about a vertical axis and the side of the rack opposite to the pinion rotation is engaged by a roller mounted on a rigid arm integrated with the moving carrier and driven by the rotating pinion. Moreover, the "edge wise" rack is longitudinally affixed to the frame of the printer roughly parallel to the guide rail means for the movable carrier such that the rack is adapted to be rotatable about one end of thereof with elasticity provided by a spring and the rack is made of polyamide resin and the like so that the rack can be rigid longitudinally thereof, as well as, flexible in a flex direction perpendicular to the longitudinal direction. This design permits manufacture of the rck and pinion mechanism from nonmetallic materials and to wider tolerances than in previous, rigidly affixed racks. In these latter respects, U.S. Pat. No. 4,687,361 achieves economies of manufacture similar to those of the present invention to be described hereinafter. However, a significant difference between the teachings of that prior patent and the present invention, is that the roller mounted on the rigid arm requires relatively tight dimensional tolerances which are costly. Also, the rigid arm design does not compensate for wear between the pinion and rack which may result in inaccurate positioning of the carrier and its related printing head. In addition the "edge wise" orientation of the rack and pinion action in U.S. Pat. No. 4,687,361 is conducive to making the mechanism susceptible to contamination from the printer correction process.

SUMMARY OF THE INVENTION:

The invention is a carrier rack drive mounted in an electronic typewriter or other printing device for controlling the movement of a carrier relative to a platen. The carrier rack drive is designed to provide significant manufacturing cost reduction over known cable drives and other rack drives. The invention is also designed to provide extremely accurate incremental carrier print head positioning.

Accordingly, it is a primary object of the present invention to provide new and improved apparatus for a carrier moving rack and pinion operation in applications such as printers.

It is another object of the present invention is to provide new and improved apparatus for a carrier moving rack and pinion operation which permits a reduction in manufacturing costs because of the use of comparatively looser dimensional tolerances in the assembled mechanism.

Still another object of the present invention is to provide new and improved apparatus for a carrier moving rack and pinion operation wherein the looser tolerances are facilitated by the reduction of wear on the carrier mechanism movement.

Still another object of the present invention is to provide new and improved apparatus for a carrier moving rack and pinion operation wherein the carrier moving mechanism will continue to function properly even after it has become worn and its tolerances are looser than those required for assembled prior art mechanisms in equivalent high tech applications.

The objects of the present invention are obtained by a new and improved carriage moving mechanism on a frame comprising;

(a) a carriage movably mounted on a guide rail means for longitudinal movement on said frame;

(b) a traveling motor fixedly mounted on said carriage including a pinion attached to a rotary shaft of said motor;

(c) a rack attached to said frame extending longitudinally substantially in parallel to said guide rail means;

(d) said rack being rigid longitudinally thereof and being flexible in a flex direction perpendicular to said longitudinal direction, said rack including a tooth side for engaging with said pinion, the surface of said rack including the line of teeth and its surface opposite said pinion being substantially parallel to said guide rail means; and (e) spring loaded slider asssembly means mounted as a part of the carriage and adapted to make continuous sliding contact with the surface of said rack in opposition to said tooth surface of the rack in the area of the pinion rotation.

The above and other objects, features and advantages of the present invention will become more apparent from the following description when taken in conjunction with the accompanying drawings in which preferred alternate embodiments of the present invention are shown by way of illustrative example.

DETAILED DESCRIPTION OF THE INVENTION

Figure 1:
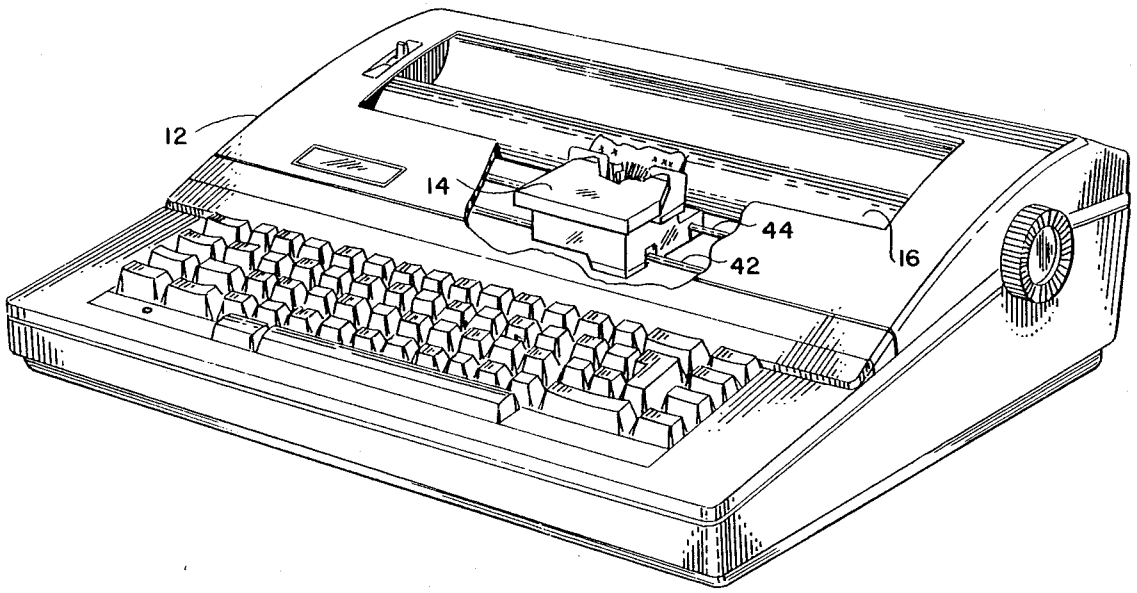
FIG. 1, is isometric view of an electronic typewriter, sectioned to show a carriage on two (2) guide rails which are of a type which might be used to guide the carriage longitudinally in relation to a platen which would contain the paper on which a printer head located on the carrier would selectively print on the paper.
Figure 2:
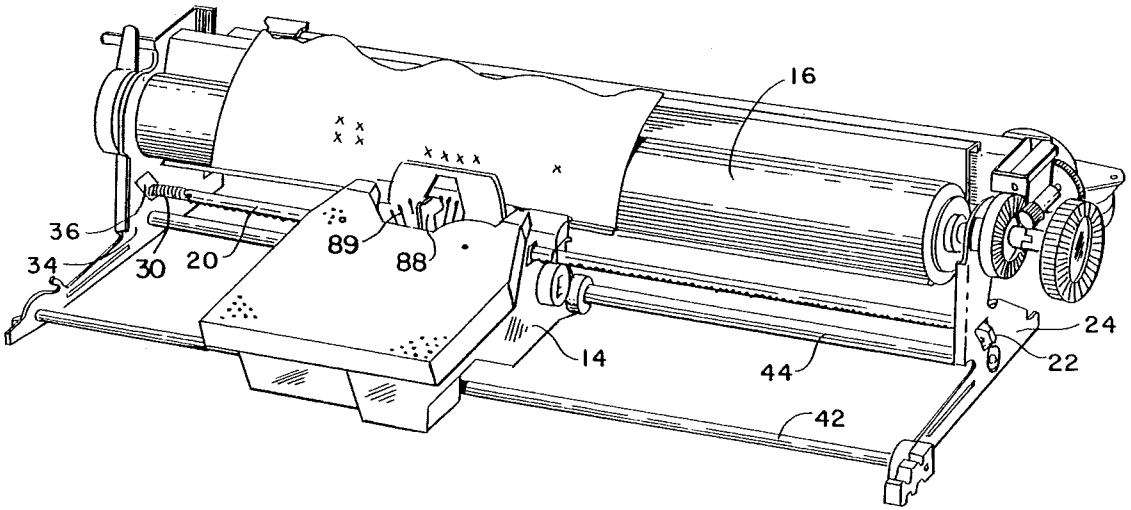
FIG. 2, is an isometric frontal view of the carriage and platen showing the rack connected to the frame of the electronic typewriter in accordance with the teachings of the present invention.
Figure 3:
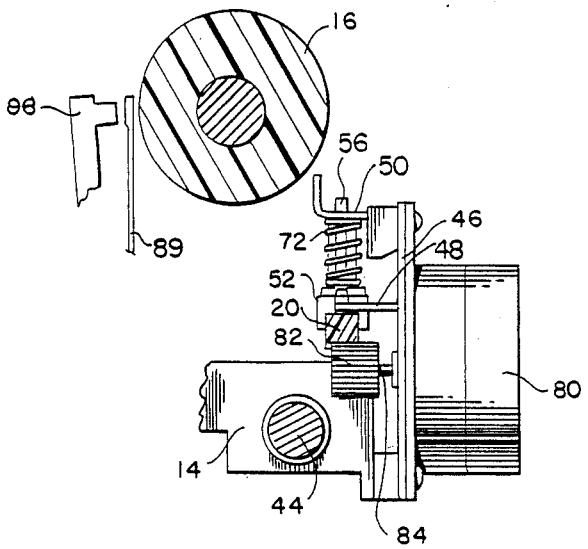
FIG. 3, shows an end elevation view of part of the carrier on which is mounted the spring loaded channel slide means assembly mounted on the carriage and adapted to make slidable contact with the surface of the rack opposite to the surface of the rack containing the teeth in the area of pinion rotation.
Figure 6:
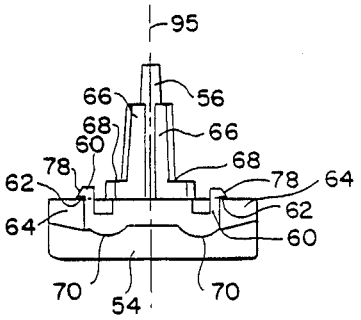
FIG. 6, shows a cross section of the channel slide means of FIGS. 3 and 4, and FIG. 5, along it long channel dimension for the purpose of showing the pads in the channel slide means for contacting the surface of the rack opposite the teeth.
Figure 5:
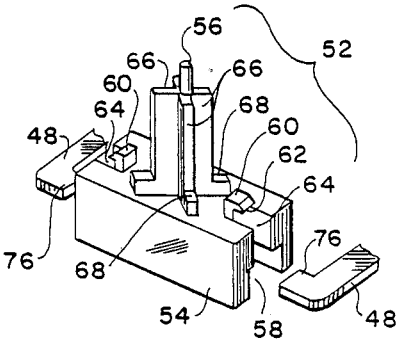
FIG. 5, is a blow up of the channel slide means which when assembled as shown in FIGS. 3 and 4, provides spring loaded sliding contact with the top of the rack at the location opposite the rotating pinion.

In FIGS. 1, 2, and 3, a carrier rack drive is mounted in an electronic typewriter 12 for controlling the movement of a carrier 14 relative to a platen 16. The carrier rack drive as depicted in FIGS. 3, 4, 7, and 8 with details shown in FIGS. 5 and 6 is designed to provide a significant manufacturing cost reduction over known cable drives and over conventional rack drives. The carrier rack drive is also designed to provide extremely accurate incremental carrier print positioning.

Figure 4:
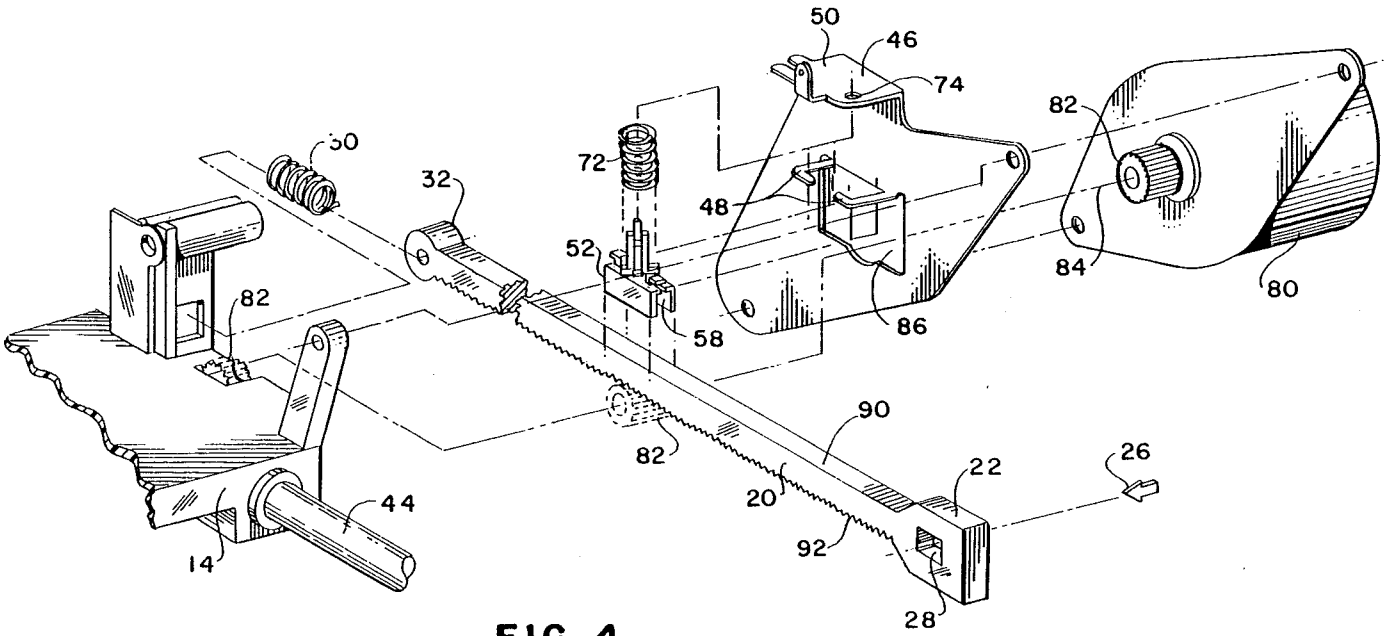
FIG. 4, shows an exploded view of the spring loaded channel slide assembly along with its diagrammatic relationship with the rack connected at its two (2) extremities.
Figure 7:
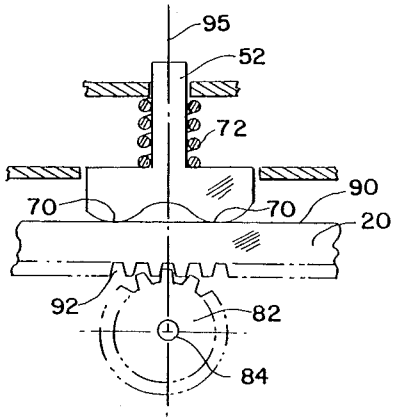
FIG. 7, shows the simplified cross section of the channel slide means as it cooperates with the rack in the area of the pinion in combination with the other parts of the channel slide means assembly.

As shown in FIGS. 2 and 4, the carrier rack drive includes a toothed rack 20 connected at one end 22 to a right side frame 24 by snap fitting over a rigid arrow shaped anchor stop pawl 26. The anchor stop pawl 26 extends through a stop opening 28 in the rack 20 in such a manner that the rack 20 is pivotable vetically relative to the anchor stop pawl 26. A spring 30 connects a second end 32 of the rack 20 to a left side frame 34 at a spring anchor 36. The spring 30 biases the rack 20 leftward from the anchor stop pawl 26 with sufficient force to prevent the rack 20 from being movable longitudinally. However, the rack 20 is capable of being slightly pivotable vertically due to the pivotable connection on the right side frame 24 and due to the spring connection at the left side frame 34. The rack 20 is preferably made of an ACETAL resin such as DELRIN so as to give rack 20 flexibility in a direction perpendicular to its longitudinal direction.

As shown in FIGS. 2, 3, and 4, a carrier 14 is mounted on a first rail 42 and on a second rail 44 for sliding movement in a direction parallel to the rack 20. A bracket 46 is rigidly assembled to the carrier 14. As shown in FIG. 3, the carrier 14, spring loaded channel slider means assembly including channel slider means 52, bracket 46, spring 72, motor 80, pinion 82 and motor shaft 84 are mechanically connected to move together longitudinally on the rail member means 42 and 44 for accurately positioning the printing mechanism 88 and 89 mounted on the carriage 14.

A pair of fingers 48 and a projection 50 are integrally formed as a part of the bracket 46 and are substantially parallel to each other. As shown in FIGS. 3, 4, 5, 6, and 7, a channel slider means 52 has a substantially block shaped base 54 and an integral post 56 extending upward from the base 54. Channel slider means 52 is preferably a molded part which may also be of elastomer material such as NYLON also known as DuPont ZYTEL. Whereas bracket 46 and fingers 48 are preferable made from cold rolled steel. Elastomer material as used herein means material which at room temperature and upon immediate release of the stress will return to its approximate original dimension allowing the channel sliding means 52 to be formed sufficiently to snap into the cooperative relationship with metal fingers 48 as described herein above. A channel 58 is formed in the bottom of the base 54 of slider means 52. A pair of flexible latches 60 have hook shaped abutments 62 at their free ends. A recess 64 is formed in the top of the base 54 adjacent each abutment 62. A plurality of L-shaped ribs 66 are integrally formed on the post 56 with an upper surface 68 on each rib 66 spaced above the base 54. A pair of slide pads 70 extend downward into the channel 58.

The slider 52 is assembled to the bracket 46 by placing a spring 72 over the post 56 and over the ribs 66. One end of the spring 72 rests on the surfaces 68 of the ribs 66. The top of the post 56 is inserted into a circular opening 74 in the projection 50. The slider 52 is pushed upward until the pair of flexible latches 60 cam over the free ends 76 of the pair of fingers 48 and the free ends 76 abut against the abutments 62 of the latches 60. The free end 76 cam over surfaces 78 on the latches 60. The spring 72 is now slightly compressed between the surfaces 68 of the ribs 66 and the projection 50 for biasing the slider 52 downward to a limited position determined by the abutments 62 of the latches 60 abutting against the free ends 76 of the latches 60.

A stepper motor 80 is assembled to the bracket 46. A pinion 82 is mounted on a motor shaft 84 and projects through an operature 86 in the bracket 46. An upper portion of the rack 20 is placed in the channel 58 of the slider 52. A top surface 90 of the rack 20 abut against both pads 70 of the slider 52. A toothed portion 92 of the rack 20 is placed in mesh with the pinion 82. When the rack 20 is in the assembled position, the abutments 62 of the latches 60 are lifted above the free ends 76 of the fingers 48. In this manner, the toothed portion 92 is biased into mesh with the pinion 82 due to the spring 72 biasing the pads 70 against the surface 90. The pads 70 are biased against the surface 90 offset from the axis 95 of the slider 52. Having two pads 70 biased against the surface 90 reduces wear by the decreased contact stress between the slider 52 and the rack 20.

The reduced manufacturing cost of this design is provided by the rack 20 being a molded plastic part; by the rack 20 being inexpensively assembled to the frame 24 by anchor stop pawl 26 and to the frame 34 by the spring 30; and by having open tolerances which are easily manufactured.

The extremely accurate incremented carrier print positioning is accomplished by having the rack 20 biased into mesh with the pinion 82 by the slider 52 which provides a constant tight mesh throughout the length of the rack 20 and during any wear that may occur.

A major aspect of the teachings of the present invention over that of the prior art is that the teeth of the rack 20 are kept in contact with the teeth of the pinion 82 by the forcing action, of a spring loaded slider 52 on the surface of the rack 20 opposite from and near the teeth of the rack 20 which are being engaged, by the driving teeth of the pinion 82. As a result, the rotating pinion 82 is moved against the spring loaded slider 52, which is moving integrally with the carrier 14 (and printing head 88). The teachings of the present invention include the proper selection of materials for the rack 20, pinion 82 and slider 52, as aforesaid.

Figure 8:
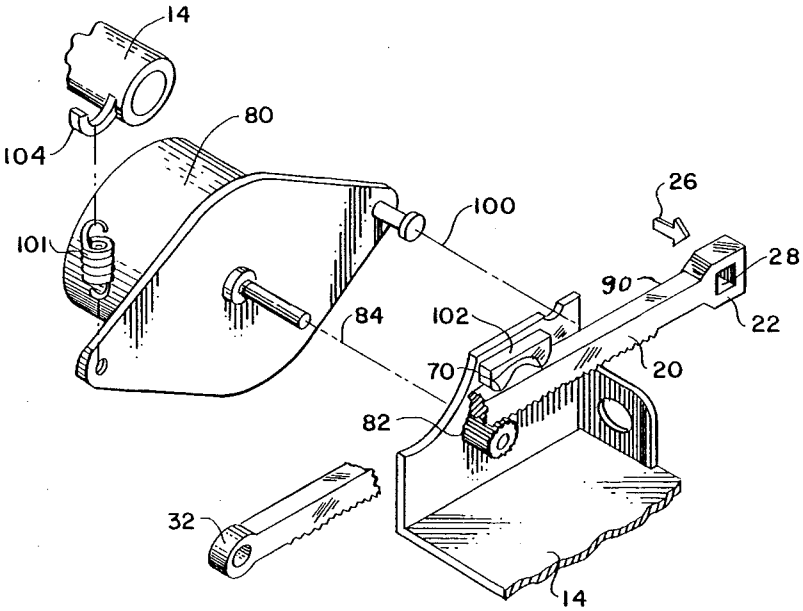
FIG. 8, shows an exploded view of an alternate embodiment of a spring loaded carriage sliding assembly functioning to hold the rotatable pinion in proper engagement with the longitudinally mounted rack in accordance with the teachings of the present invention.

The embodiments of the teachings of the present invention in addition to the one shown in FIGS. 3–7 will occur to those skilled in the art. For example, as shown in FIG. 8, the rack 20 can remain attached and constructed as set forth hereinabove but the relationship of the carrier 14 and motor 80 and pinion 82 previously fixed to move together in total integration can be modified so that while they continue to move together in the longitudinal direction of the rack 20 as before, the motor 80, shaft 84 and pinion 82 can be modified to swing about a pivot axis and shaft 100 mounted on the carrier 14 so that a spring 101 (connected to the perimeter of motor 80 remote from it pivot (shaft 100) point at one end and to an upper projection 104 of the carrier 14 at the other end) will urge the shaft 84 and pinion 82 in the direction of meshing the pinion 82 teeth into rack 20 teeth on the teeth side of the rack 20 and the top surface 90 of the rack 20 against a slider 102 which is mounted integrally to move with the carrier 14, as shown. In this embodiment, the back wall of the carrier 14 must be cut away in the manner to allow the shaft 84 and pinion 82 and motor 80 to pivot as shown. The surface of slider 102 is again shown with two pads 70. The material for the rack, pinion and slider is selected to reduce wear and cost etc.

Herein the words "carrier" and "carriage" are used interchangeably. Moreover, the carriage may be made of a glass reinforced polycarbonate material with the addition of TEFLON for lubricity is desired.

The material identified herein for the key parts are intended to be examples only.

Although certain preferred embodiments have been shown an described, it should be understood that many changes and modifications may be made therein without departing from the scope of the appended claims.

What is claimed is:

1. A print carriage moving mechanism on a printer frame comprising:

(a) a print carriage movably mounted on a guide rail means for longitudinal movement on said printer frame;

(b) a traveling motor fixedly mounted on said print carriage including a pinion attached to a rotary shaft of said motor;

(c) a rack having a line of teeth on one side and a flat surface on the opposite side thereof attached to said printer frame extending longitudinally substantially in parallel to said guide rail means;

(d) said rack being rigid longitudinally thereof and being flexible in a flex direction, perpendicular to its longitudinal direction, said rack's one side engaging said pinion, the one side of said rack including the line of teeth and the flat surface opposite said pinion being substantially parallel to said guide rail means; and (e) spring loaded slider assembly means mounted as a part of said print carriage making continuous sliding contact with the flat surface of said rack opposite to said one side of the rack in the area of the pinion rotation.

2. A print carriage moving mechanism on a printer frame as claimed in claim 1 wherein, one end of said rack being rotatably and elastically mounted on said frame, at a location near one terminus of carriage movement and the other end of said rack being directly fixed to said frame at a location near the other terminus of movement of said carriage.

3. A print carriage moving mechanism on a printer frame as claimed in claim 1 wherein, said spring loaded slider assembly means mounted as a part of said carriage and making continuous sliding contact with the flat surface of said rack in opposition to said one side of the rack in the area of the pinion rotation is a channel and the traveling motor, the carriage and the pinion driven by the motor are integral.

4. A print carriage moving mechanism on a printer frame as claimed in claim 1 wherein, said spring loaded slider assembly means mounted as a part of said carriage and making continuous sliding contact with the flat surface of said rack in opposition to said one side of the rack in the area of the pinion rotation comprises a slider fixedly integral with the carrier and the traveling motor, its shaft and driven pinion swingable about a pivot axis under the urging of a spring connected between the motor and an upper projection of said carrier.

5. A print carriage moving mechanism comprising:

(a) a print carriage mounted for movement in a longitudinal direction on longitudinally extending guide rail means;

(b) a traveling motor fixedly mounted on said print carriage, said traveling motor including a pinion mounted on a rotary shaft thereof;

(c) a rack extending substantially in parallel to said guide shaft; said rack being rigidly longitudinally and flexible in a flex direction perpendicular to said longitudinal direction, said rack having a longitudinally extending tooth surface engaged with said pinion, another sliding surface of said rack located opposite to said tooth surface being substantially parallel to said guide rail means, said tooth surface and said another sliding surface being spaced apart in said flex direction, said rack having a stop pawl and a stop hole at one longitudinal end thereof; and (d) a spring loaded slide assembly mounted on said print carriage, and making contact with said another sliding surface of said rack in an area above and in line with said pinion so as to resist any disengagement of said tooth surface from said pinion.

* * * * *